US010577795B2

(12) United States Patent
Lee

(10) Patent No.: US 10,577,795 B2
(45) Date of Patent: Mar. 3, 2020

(54) CONSTRUCTION PANEL ASSEMBLY AND CONSTRUCTION METHOD USING SAME

(71) Applicant: Chung Jong Lee, Seoul (KR)

(72) Inventor: Chung Jong Lee, Seoul (KR)

( * ) Notice: Subject to any disclaimer, the term of this patent is extended or adjusted under 35 U.S.C. 154(b) by 87 days.

(21) Appl. No.: 15/885,956

(22) Filed: Feb. 1, 2018

(65) Prior Publication Data

US 2018/0163399 A1 Jun. 14, 2018

Related U.S. Application Data

(60) Continuation of application No. 15/152,650, filed on May 12, 2016, now Pat. No. 9,920,521, which is a division of application No. 14/843,222, filed on Sep. 2, 2015, now Pat. No. 9,850,656.

(30) Foreign Application Priority Data

Sep. 2, 2014 (KR) ..... 10-2014-0116215
Nov. 6, 2014 (KR) ..... 10-2014-0153727

(51) Int. Cl.

| | |
|---|---|
| ***E04B 2/74*** | (2006.01) |
| ***E04B 2/30*** | (2006.01) |
| ***E04B 2/76*** | (2006.01) |
| *E04B 2/78* | (2006.01) |

(52) U.S. Cl.

CPC ..... *E04B 2/7407* (2013.01); *E04B 2/30* (2013.01); *E04B 2/7453* (2013.01); *E04B 2/76* (2013.01); *E04B 2/7455* (2013.01); *E04B 2/789* (2013.01); *E04B 2/7836* (2013.01); *E04B 2002/7461* (2013.01)

(58) Field of Classification Search

CPC . E04B 2/72; E04B 2/74; E04B 2/7401; E04B 2/7405; E04B 2/7407; E04B 2/7416; E04B 2/742; E04B 2/7448; E04B 2/7453; E04B 2/7455; E04B 2/76; E04B 2/767; E04B 2/768; E04B 2/78; E04B 2/7809; E04B 2/7818; E04B 2/7836; E04B 2/789; E04B 2/7872; E04B 2/82; E04B 2/821; E04B 2002/7487; E04B 2002/749; E04B 2002/7492; E04B 2002/7494; E04B 2002/7496; E04B 2002/7461

See application file for complete search history.

(56) References Cited

U.S. PATENT DOCUMENTS

| | | | |
|---|---|---|---|
| 1,418,257 | A | 5/1922 | Hay |
| 1,741,979 | A | 12/1929 | Dawson |
| 1,873,350 | A | 8/1932 | Smith |
| 2,094,607 | A | 10/1937 | Kotrbaty |

(Continued)

FOREIGN PATENT DOCUMENTS

| | | | |
|---|---|---|---|
| CA | 2803637 | A1 | 7/2013 |
| KR | 20-0225503 | Y1 | 6/2001 |

(Continued)

*Primary Examiner* — Jessica L Laux

(74) *Attorney, Agent, or Firm* — Novick, Kim & Lee, PLLC; Jae Youn Kim

(57) ABSTRACT

Provided is a construction panel assembly, which is applicable to a detachable method capable of assembling and disassembling a ceiling, a wall or a floor material which partitions spaces of various kinds of buildings. Also, the construction panel assembly allows materials to be reused, so that the generation of construction waste may be minimized.

18 Claims, 11 Drawing Sheets

(56) References Cited

U.S. PATENT DOCUMENTS

| | | | | |
|---|---|---|---|---|
| 2,101,073 | A | 12/1937 | Kotrbaty | |
| 2,125,136 | A | 7/1938 | Trojanowski | |
| 2,166,098 | A | 7/1939 | Kotrbaty | |
| 2,169,253 | A | 8/1939 | Kotrbaty | |
| 2,169,254 | A | 8/1939 | Kotrbaty | |
| 2,351,525 | A | 6/1944 | Leary | |
| 2,706,541 | A | 4/1955 | Crown | |
| 2,803,321 | A | 8/1957 | Fox-Williams | |
| 2,877,515 | A | 3/1959 | Haas | |
| 3,024,881 | A | 3/1962 | Haas | |
| 3,193,061 | A | 7/1965 | Downes | |
| 3,199,641 | A | 8/1965 | Yake | |
| 3,203,053 | A | 8/1965 | Lane | |
| 3,368,312 | A | 2/1968 | Shore | |
| 3,371,454 | A | 3/1968 | Anderson | |
| 3,377,756 | A | 4/1968 | Polhamus | |
| 3,389,527 | A | 6/1968 | Collard | |
| 3,403,491 | A | 10/1968 | Eichman | |
| 3,411,252 | A | 11/1968 | Boyle, Jr. | |
| 3,537,217 | A | 11/1970 | Lickliter | |
| 3,537,219 | A | 11/1970 | Navarre | |
| 3,574,985 | A | 4/1971 | Pierce | |
| 3,866,376 | A | 2/1975 | Nelsson | |
| 3,866,377 | A | 2/1975 | De Schutter | |
| 3,922,764 | A | 12/1975 | Downing, Jr. | |
| 3,975,881 | A | 8/1976 | Ninowski, Jr. | |
| 4,038,790 | A * | 8/1977 | Paisley | A47B 96/1416 52/36.5 |
| 4,094,114 | A | 6/1978 | Burcham | |
| 4,151,691 | A | 5/1979 | Wendt | |
| 4,209,953 | A | 7/1980 | Wendt | |
| 4,245,442 | A | 1/1981 | Durham | |
| 4,255,910 | A | 3/1981 | Wendt | |
| 4,356,672 | A | 11/1982 | Beckman | |
| 4,361,994 | A | 12/1982 | Carver | |
| 4,443,991 | A | 4/1984 | Mieyal | |
| 4,621,478 | A | 11/1986 | Phillips | |
| 4,698,946 | A | 10/1987 | Wendt | |
| 4,949,518 | A | 8/1990 | Nagel | |
| 4,979,346 | A | 12/1990 | Pollard | |
| 5,115,610 | A | 5/1992 | Kessler | |
| 5,125,201 | A | 6/1992 | Pieters | |
| 5,274,975 | A | 1/1994 | Haag | |
| 5,540,019 | A | 7/1996 | Beske | |
| 5,822,935 | A | 10/1998 | Mitchell | |
| 5,855,100 | A | 1/1999 | Hsueh | |
| 6,122,871 | A * | 9/2000 | Russell | E04B 2/82 52/126.3 |
| 6,141,925 | A | 11/2000 | Halvorson, Jr. | |
| 6,711,870 | B1 | 3/2004 | Richardson | |
| 6,807,778 | B2 | 10/2004 | Engebretson | |
| 6,904,720 | B1 | 6/2005 | Adolfson | |
| 7,562,504 | B2 | 7/2009 | Herbst | |
| 9,556,610 | B2 | 1/2017 | Pozza | |
| 2005/0095060 | A1 | 5/2005 | Buttau | |
| 2006/0000182 | A1 | 1/2006 | McGee | |
| 2006/0179789 | A1 | 8/2006 | Nicoletti | |
| 2006/0230705 | A1 | 10/2006 | Grandi | |
| 2008/0134610 | A1 | 6/2008 | Jakob-Bamberg | |
| 2009/0294613 | A1 | 12/2009 | Cline | |
| 2010/0095615 | A1 * | 4/2010 | Houle | E04B 2/7448 52/264 |
| 2012/0096780 | A1 | 4/2012 | Metcalf | |
| 2013/0192141 | A1 | 8/2013 | Kopish | |
| 2014/0208673 | A1 | 7/2014 | Huang | |
| 2015/0047280 | A1 * | 2/2015 | Staten | E04B 2/7455 52/281 |
| 2015/0354212 | A1 | 12/2015 | Von Hoyningen Huene | |
| 2015/0376899 | A1 * | 12/2015 | Joseph | E04B 2/7401 52/241 |

FOREIGN PATENT DOCUMENTS

| | | | |
|---|---|---|---|
| KR | 10-2002-0030837 | A | 4/2002 |
| KR | 20-0407302 | Y1 | 1/2006 |
| KR | 10-2006-0110920 | A | 10/2006 |
| KR | 10-0758442 | B1 | 9/2007 |
| KR | 10-0772149 | B1 | 10/2007 |
| KR | 10-2008-0013387 | A | 2/2008 |
| KR | 10-1029151 | B1 | 4/2011 |
| KR | 10-2013-0093318 | A | 8/2013 |

* cited by examiner

CONSTRUCTION PANEL ASSEMBLY AND CONSTRUCTION METHOD USING SAME

CROSS-REFERENCE TO RELATED APPLICATIONS

This application is a continuation of U.S. application Ser. No. 15/152,650 filed May 12, 2016, which is a divisional application of U.S. application Ser. No. 14/843,222 filed on Sep. 2, 2015, which is now U.S. Pat. No. 9,850,656 issued Dec. 26, 2017 and which claims priority under 35 U.S.C. § 119(a) to Korean Patent Application No. 10-2014-0116215 filed on Sep. 2, 2014, and Korean Patent Application No. 10-2014-0153727 filed on Nov. 6, 2014, the contents of which are hereby incorporated by reference in their entirety.

BACKGROUND

The present disclosure relates to a construction panel assembly which may be assembled and disassembled to partition an indoor space of a building and a construction method using the same, and more particularly, to a construction panel assembly and a construction method using the same, in which a flat panel is mounted on a structure formed in such a way that a main frame and an auxiliary frame are inserted into each other. Thus, materials may be reused, and the generation of waste may be maximally prevented.

In general, to construct a typical building, a base framework is built through a method in which concrete is formed in a concrete form or steel beams are installed based on design specifications, and then, indoor or outdoor portions such as roofs, ceilings, walls and floors are built and finished.

Various kinds of buildings are used by partitioning one large indoor space into several small spaces for user convenience without damaging the existing structure of a building, and walls for partitioning the space are classified into fixed walls and assembly walls.

Fixed walls include masonry walls which need masonry work, plastering work, painting work or wallpapering work to be performed, and wood partitioning walls which need carpentry work, painting or wallpapering work to be performed. Since multiple processes need to be combined to complete a fixed wall, recently, an assembly wall, which is produced as a single panel formed through several processes and assembled, is popular and is being widely used in construction.

For construction panels, various functional or decorative characteristics such as ease of construction, stiffness and supporting strength, including thermal insulation, fire resistance, waterproofing, and appearance, are required. Recently, various types of construction materials have been widely developed to satisfy these characteristics.

Until now, since construction panels have also been constructed in a fixed type with respect to non-bearing walls, which are not bearing walls, when a situation arises in which a wall needs to be changed, the reuse of existing materials is almost impossible because the wall is completely removed and then new materials are installed.

For example, although a steel wall called a steel gypsum panel (SGP) is configured to be assemblable and disassemblable, this steel wall may not be applied to a whole pane of glass wall or a wall including a gypsum panel which is painted or wallpapered. Although this steel wall is separated into a structure material and a finishing material, this steel wall has the disadvantages in that it should be only used for SGP materials and does not sufficiently block noise, etc. because it does not have a shielded structure.

Moreover, also in construction methods, since finishing materials are coupled to structure materials by using screws, etc., screw heads are exposed. Since an additional packing should be inserted to compensate for this drawback, the consistent connection of walls, such as painting or wallpapering becomes impossible.

In relation to the installation of construction panels as described above, for example, Korean Patent No. 0695700 discloses a technique which is highly effective for noise blocking and heat insulation, shows noise blocking and fire resisting properties also for studs that form the coupling between panels, has a simple structure allowing for the mutual coupling of parts so as to make assembly convenient, and also allows for assembled firmness. However, since this is nothing but a technique for continuously coupling panels to each other by installing concave-convex portions at both ends with complex structures of the panels themselves, the technique may not be applied to the construction of a whole pane of glass or a whole wall.

Also, Korean Patent No. 0838961 discloses a technique, in which a modular wall is coupled to a fixing rod by sliding into the fixing rod after the fixing rod is screwed to a ceiling and a floor such that the wall may be simply and quickly installed and removed while minimizing damage to the ceiling and the floor, and thus improve ease of maintenance and repair. However, since the structure of the fixing stud for constructing a wall is complicated, and an elastic body such as a spring or an additional support plate is required to be assembled, a rise in price is caused by the manufacturing of additional materials, and the construction process becomes difficult.

A typical assembly structure of a construction panel will be described below as an example. As illustrated in the accompanying FIGS. 1 and 2, a steel stud 130 for a non-bearing 2 0 wall is installed between a floor 110 and a ceiling 120 for constructing a typical drywall 100.

The steel stud 130 includes upper and lower track members 132 and 134 coupled to the sides of the floor 110 and the ceiling 120 by using an anchor bolt or the like (not shown) and stud members 136 functioning as a plurality of vertical beams assembled between the track members.

Also, the stud members 136 are fixed by a fixing member 138*a* horizontally disposed between the stud members 136 and a connection member 138*b* disposed to continuously extend in a longitudinal direction thereof, and concurrently, are finally are bound by a finishing material such as gypsum board 140, and the stud members 136 and the upper and lower track members 132 and 134 are coupled by screws 142.

Accordingly, as illustrated in FIG. 2, since the stud members 136 are fastened by the screws 142 from the outside of the track members after the stud members 136 are inserted between the track members 132 and 134 in the case of the typical drywall 100, head portions of the screws 142 protrude more than planes of the track members.

As a result, in the case of the typical wall 100, there is a limitation in that the process of installing the finishing member 140 after installing the steel stud 130 is interrupted by the head portions of the screws, or a space is generated in the process.

Furthermore, since the gypsum boards 140 should be finally installed at both sides of the steel stud 130, respectively, the wall becomes thicker, it is cumbersome to perform multiple stages of screw fastening, and it is also undesirable in the aspects of overall material cost or practical use.

SUMMARY

Embodiments provide a construction panel assembly and a construction method using the same, which are applicable to a detachable method capable of assembling and disassembling almost all walls as well as a typical glass wall or gypsum wall, and also allow materials to be reused, so that the generation of construction waste may be minimized.

Embodiments also provide a construction panel assembly and a construction method using the same, in which structure materials and finishing materials that constitute a wall structure may be firmly fixed to each other even without using separate screws, and the construction thereof is very simple such that overall costs may be greatly reduced.

Embodiments also provide a construction panel assembly and a construction method using the same, in which various kinds of wires are not exposed to the outside by using structure materials and finishing materials that constitute a wall structure, such that an indoor space may be more cleanly used.

In one embodiment, a construction panel assembly includes: a main frame disposed in a mutually opposed arrangement on a wall surface at a predetermined position determined according to design specifications; an auxiliary frame inserted into the main frame to define a structure; a flat panel mounted on the structure to partition a space; and a finishing member for shielding a connection portion of the main frame and the auxiliary frame.

The main frame may include a first main frame; the auxiliary frame may include a flat panel fixing member inserted into the first main frame; and the finishing member may include a molding and a washboard for shielding the connection portion of the first main frame and the flat panel fixing member. The flat panel may be mounted between the first main frame and the flat panel fixing member to partition a space, the first main frame may include body support members, flat panel support members, flat panel guide members, washboard insertion protrusions, washboard insertion grooves, and support member connection protrusions, which are formed at both end portions thereof, and the molding may be inserted into a molding insertion groove defined by the body support members and the flat panel support members formed at both end portions of the first main frame. The flat panel fixing member may have a support member connection groove coupled to the first main frame and formed at one side end thereof. The flat panel may be inserted into a gap defined by the first main frame and the flat panel fixing member and defines a wall structure. The molding and the washboard may be fixedly coupled to an insertion protrusion and a groove formed in the first main frame and the flat panel fixing member and also insertedly installed so as to shield a connection portion of the first main frame and the flat panel fixing member.

Gasket fixing protrusions may be formed in the body support members and the flat panel support members of the first main frame such that the molding integrated with a gasket may consolidate coupling after being inserted into the molding insertion groove.

The washboard may be inserted into the washboard insertion protrusions and the washboard insertion grooves which are formed in the first main frame and the flat panel fixing member, and then, a washboard fixing member may consolidate coupling to a floor.

The main frame may include a second main frame; the auxiliary frame may include an intermediate frame inserted into the second main frame; and the finishing member may include a finishing cover for shielding a connection portion of the second main frame and the intermediate frame, wherein the flat panel may be mounted between the intermediate frames to partition a space; the second main frame may include a mounting groove formed in a central portion thereof and a support member including openings at both sides of the mounting groove; the intermediate frame may include a protrusion portion inserted into the mounting groove of the second main frame and reinforcement members formed at both sides of the protrusion portion; the flat panel may be configured to define a wall structure by being inserted into the insertion groove of the intermediate frame; the finishing cover may be insertedly installed so as to simultaneously cover the support member of the second main frame and the reinforcement member of the intermediate frame, and may be configured to maintain a mutually assembled state through a fixing member interposed between the second main frame and the intermediate frame; and the fixing member may include a horizontal body and vertical bodies integrally formed on upper and lower surfaces of the horizontal body.

The second main frame may include a reinforcement protrusion integrally formed on a bottom surface thereof such that a gap may be maintained when being coupled to a floor.

A groove may be formed and caulked between the second main frame and the finishing cover.

The second main frame and the intermediate frame may include wire insertion grooves through which a wire passes.

In another embodiment, provided is a method of constructing a construction panel assembly applicable to a ceiling, a wall structure or a floor material which partitions a space of a building, the method including: marking a reference line on a wall surface at a predetermined position based on design specifications; disposing and fixing a first main frame along the reference line; and supporting a flat panel by integrally coupling flat panel fixing member by using a support member connection protrusion formed in the first main frame and a concave-convex structure of a support member connection groove formed in the flat panel fixing member after placing the flat panel on the first main frame.

The method of constructing a construction panel assembly may further include inserting and assembling a molding into a molding insertion groove defined by body support members and flat panel support members at both ends of the first main frame.

The method of constructing a construction panel assembly may further include inserting and assembling a washboard into a washboard insertion protrusion and a wash board insertion groove, which are formed on the first main frame and the flat panel fixing member.

The method of constructing a construction panel assembly may further include interposing connection frames on both sides of the flat panel fixed by the first main frame and the flat panel fixing member, and assembling the connection frames to a post frame.

The method of constructing a construction panel assembly may further include assembling a wall structure by inserting a protrusion formed in the connection frame into a convex groove formed in the post frame.

The method of constructing a construction panel assembly may further include freely assembling a wall structure in a shape of a character such as "L", "T", and "+" by using the post frame.

In another embodiment, provided is a method of constructing a construction panel assembly applicable to a ceiling, a wall structure or a floor material which partitions a space of a building, the method including: marking a reference line on a wall surface at a predetermined position based on design specifications; disposing and fixing a second main frame along the reference line; inserting and coupling an insertion groove formed in the intermediate frame into a coupling portion of the flat panel; inserting and assembling both ends of the intermediate frame to which the flat panel is coupled into a mounting groove formed in the second main frame; and interposing a fixing member, which includes a horizontal body and vertical bodies integrally formed on upper and lower surfaces of the horizontal body respectively, between the second main frame and the intermediate frame while both ends of the intermediate frame are inserted into the mounting groove of the second main frame so as to maintain a mutually assembled state.

The method of constructing a construction panel assembly may further include interposing a connection frame on a vertical surface after mounting the intermediate frame on upper and lower ends of the flat panel, and assembling the connection frame to the post frame.

The method of constructing a construction panel assembly may further include assembling all wall structures to define a right angle or 180 degrees between the all wall structures by using the post frame.

The details of one or more embodiments are set forth in the accompanying drawings and the description below. Other features will be apparent from the description and drawings, and from the claims.

DETAILED DESCRIPTION OF THE EMBODIMENTS

Figure 1:
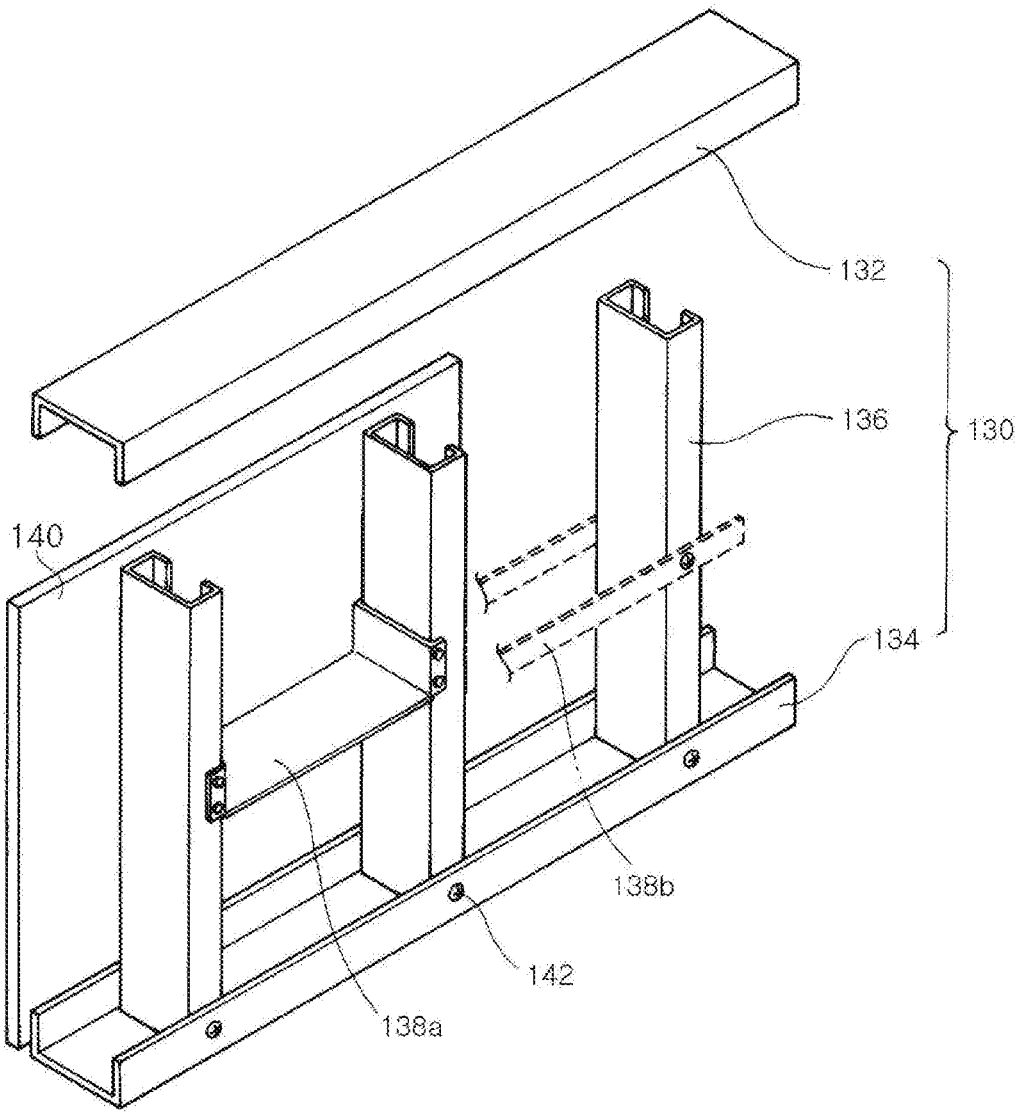
FIG. 1 is a perspective view illustrating a drywall using a typical steel stud.
Figure 2:
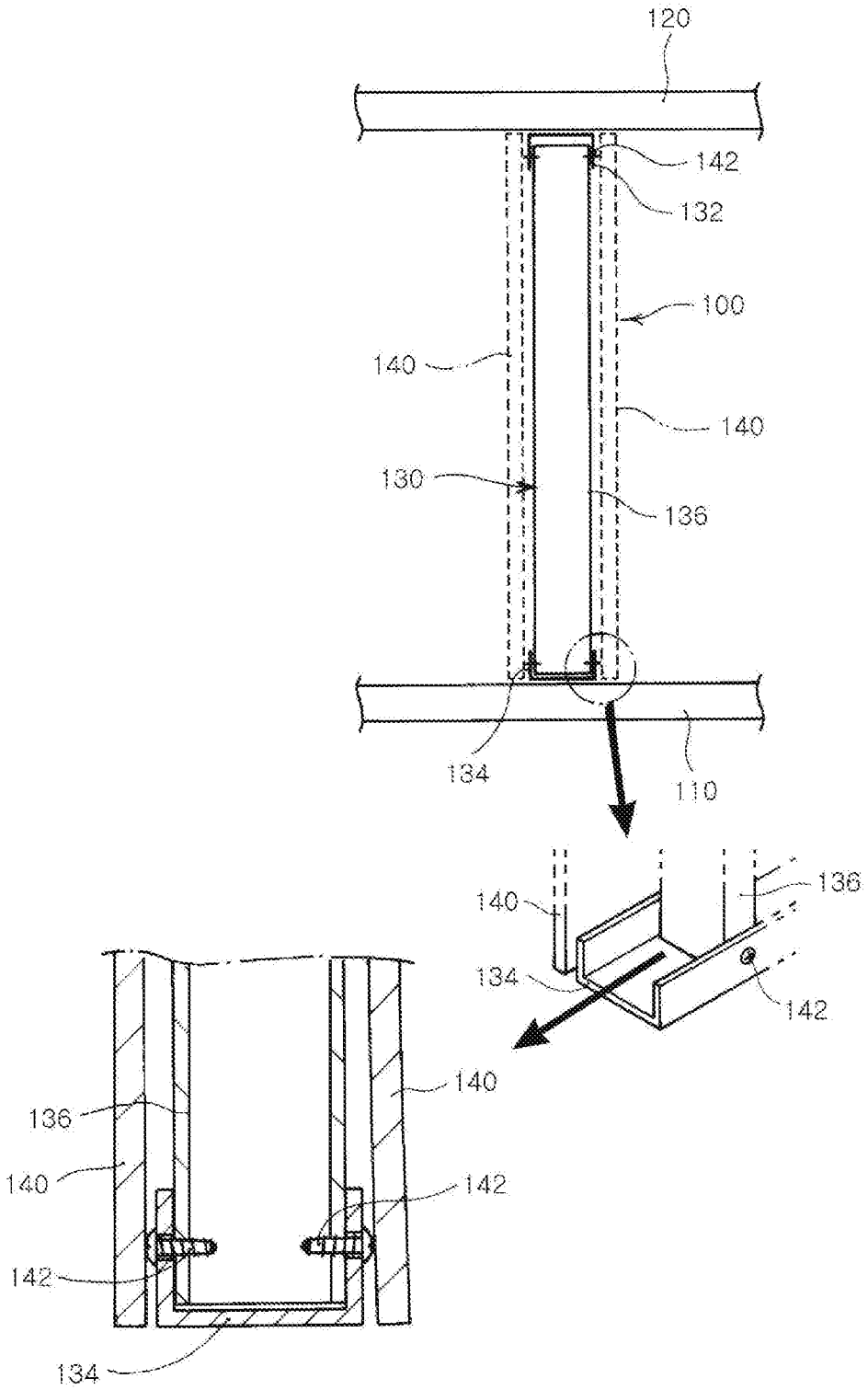
FIG. 2 is a configuration diagram illustrating an assembled state of the drywall illustrated in FIG. 1.

Hereinafter, exemplary embodiments of the present disclosure will be described in detail with reference to the accompanying drawings.

Prior to the detailed description of the present disclosure, particular structures or the functional descriptions are only exemplary for the purpose of describing embodiments according to the concepts of present invention, and the embodiments according to the concepts of present invention may be implemented in various forms and shall not be interpreted as limiting the embodiments described in this specification.

Also, embodiments may have various modifications made thereto and may have many different forms according to the concepts of the present invention. Thus specific embodiments are provided as examples in the drawings and are described in detail in this specification.

The present disclosure relates to a construction panel assembly which may be assembled and disassembled to partition an indoor space of a building and a construction method using the same. A construction panel assembly according to an embodiment includes a main frame disposed to be arranged to be mutually opposed on a wall surface at a predetermined position determined according to design specifications, an auxiliary frame inserted into the main frame to define a structure, a flat panel 400 mounted on the structure to partition a space, and a finishing member for shielding a connection portion of the main frame and the auxiliary frame.

Hereinafter, a construction panel assembly and a construction method using the same according to a first embodiment will be firstly described.

Figure 3:
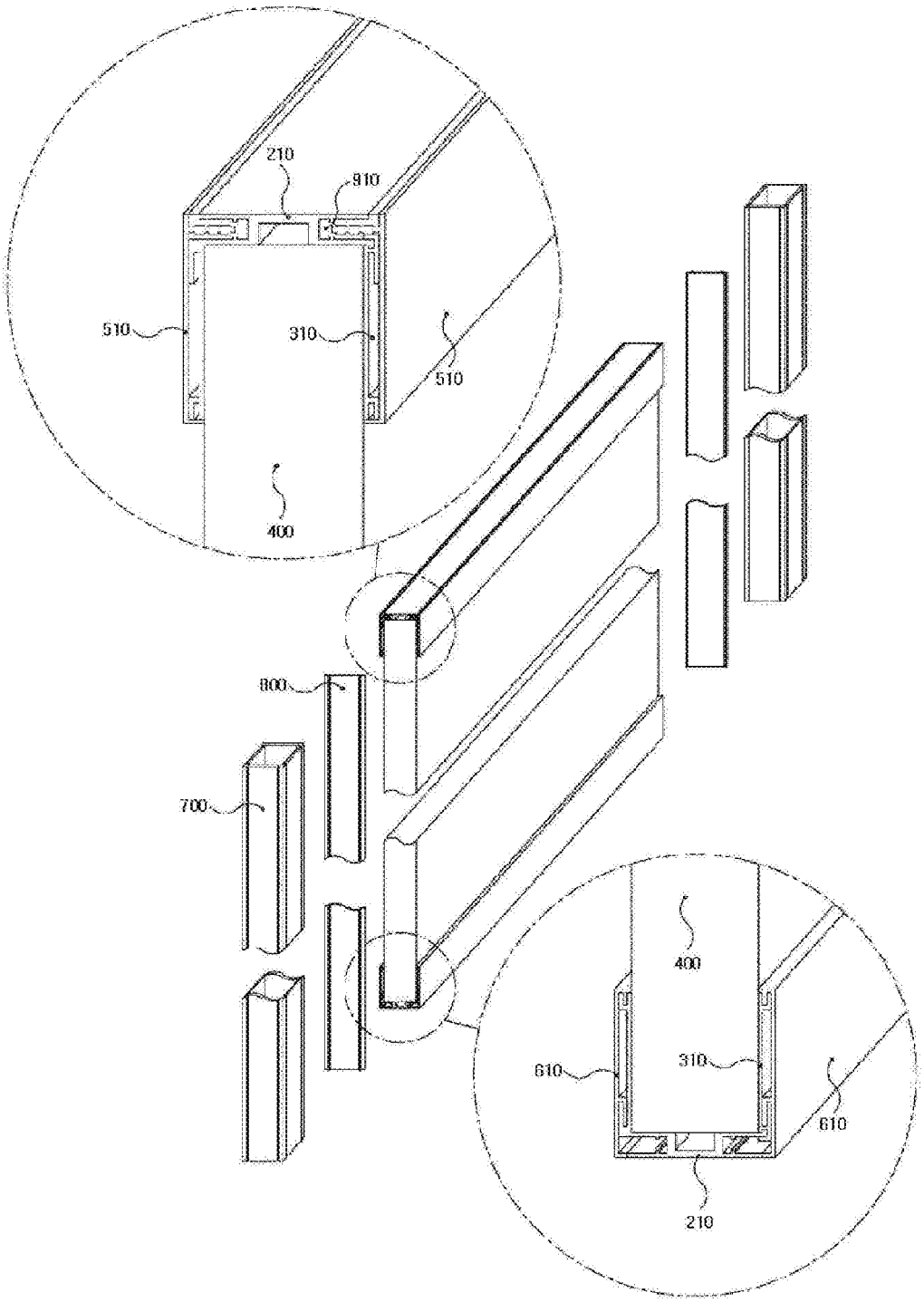
FIG. 3 is an overall perspective view illustrating a construction panel assembly according to a first embodiment.
Figure 4:
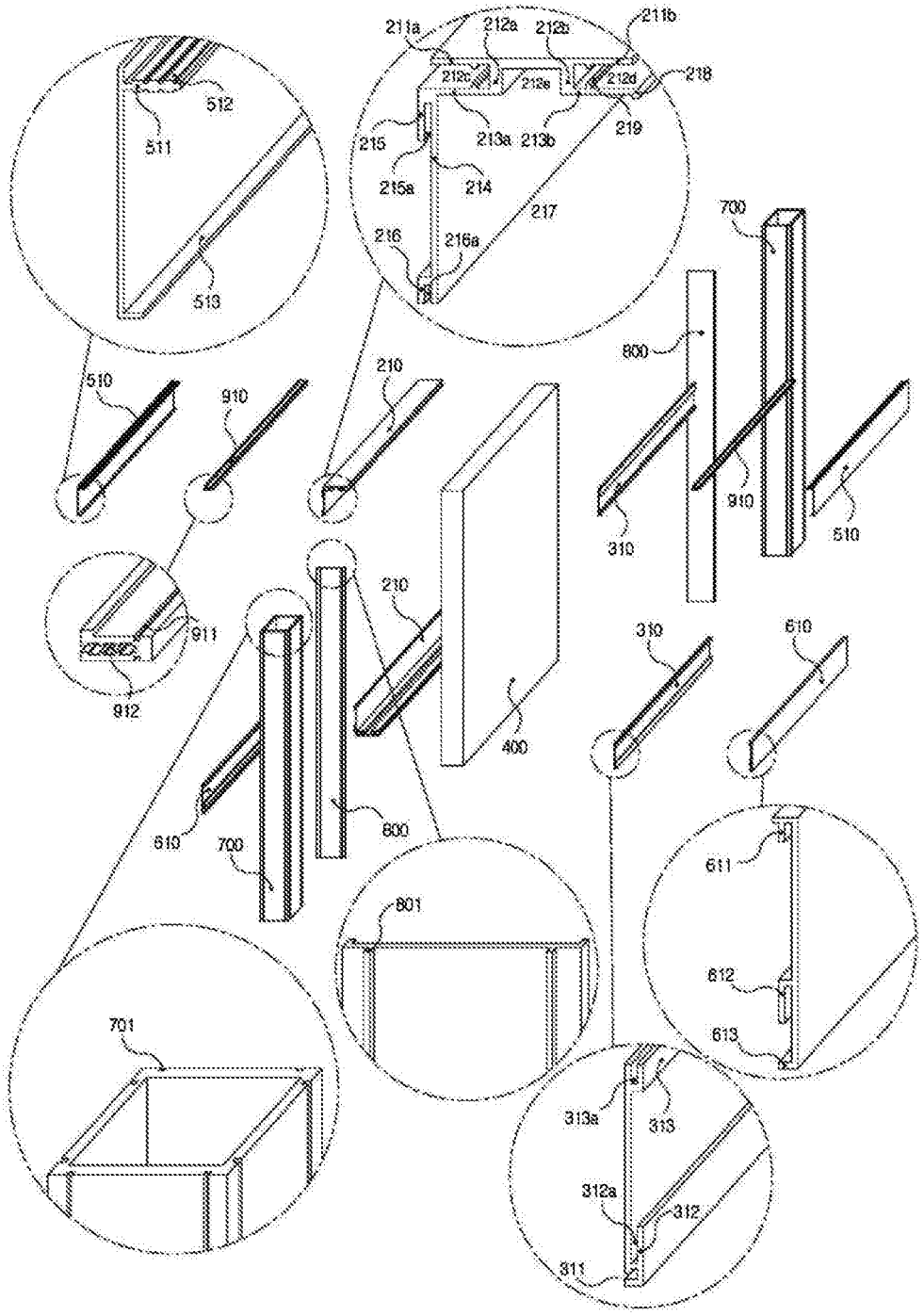
FIG. 4 is a perspective view illustrating each member of a construction panel assembly according to the first embodiment.

FIG. 3 is an overall perspective view illustrating a construction panel assembly according to a first embodiment, and FIG. 4 is a perspective view illustrating each member of a construction panel assembly according to the first embodiment.

In the first embodiment, the main frame includes a first main frame 210, the auxiliary frame includes a flat panel fixing member 310 inserted into the first main frame 210, and the finishing member includes a molding 510 and a washboard 610 for shielding the connection portion of the first main frame 210 and the flat panel fixing member 310. The flat panel 400 is mounted between the first main frame 210 and the flat panel fixing member 310 to partition a space.

As illustrated in the drawings, the present disclosure may be most preferably applied to a wall structure for partitioning a space in a building and include: a first main frame 210 basically fixedly installed between a ceiling and a floor; a flat panel fixing member 310 inserted into the first main frame 210; a flat panel 400 mounted in a flat panel insertion groove 217 defined by the first main frame 210 and the flat panel fixing member 310; and a molding 510 and a washboard 610 for shielding a connection portion of the first main frame 210, the flat panel fixing member 310 and the flat panel 400.

The first main frame 210 is installed on a ceiling and a floor at a position determined according to design specifications. That is, the main frame 210 may be simply fixed by using a fastening element, such as a small screw (not shown), while the main frame 210 is arranged along reference lines (not shown) marked on the ceiling and the floor.

Also, the flat panel 400 is inserted while being brought in contact with body support members 211*a* and 211*b*, flat panel support members 213*a* and 213*b*, and a flat panel guide member 214 of the first main frame 210 fixed to the ceiling and the floor. Then, a support member connecting groove 311 formed in the flat panel fixing member 310 is fastened to a support member connecting protrusion 218 formed at one end portion of the first main frame 210, such that the first main frame 210 and the flat panel fixing member 310 are fixed and the flat panel 400 is simultaneously mounted. Also, the flat panel 400 is inserted into a flat panel insertion groove 217 defined by the first main frame 210 and the flat panel fixing member 310 to define a wall surface. Almost all materials formed into panels, such as wood or gypsum, steel, and glass plates may be used as materials for the flat panel 400.

A gasket 910 is inserted into a gasket insertion member 511. Then, the molding 510 is inserted into molding insertion grooves 212*c* and 212*d*, which are defined by the body support members 211*a* and 211*b*, horizontal connection frame support members 212*a* and 212*b*, and the flat panel support members 213*a* and 213*b* of the first main frame 210, from both sides of the first main frame 210 so as to shield all connection portions in an upper portion of the wall structure. Here, gasket fixing protrusions 219 and 512 and a molding fixing protrusion 912 have an effect of consolidating the coupling of the first main frame 210, the gasket 910, and the molding 510.

The washboard 610 shields all connection portions in a lower portion of the wall structure in such a way that a washboard upper insertion protrusion 611 is fastened into a washboard insertion groove 216*a* defined by a washboard insertion protrusion 216 of the first main frame 210, and a washboard lower insertion protrusion 612 is fastened into a washboard insertion groove 215*a* defined by a washboard insertion protrusion 215 of the first main frame 210. Here, a washboard finishing member 613 contacts a floor surface to have an effect of consolidating the coupling of the washboard 610 and the first main frame 210.

Figure 11:
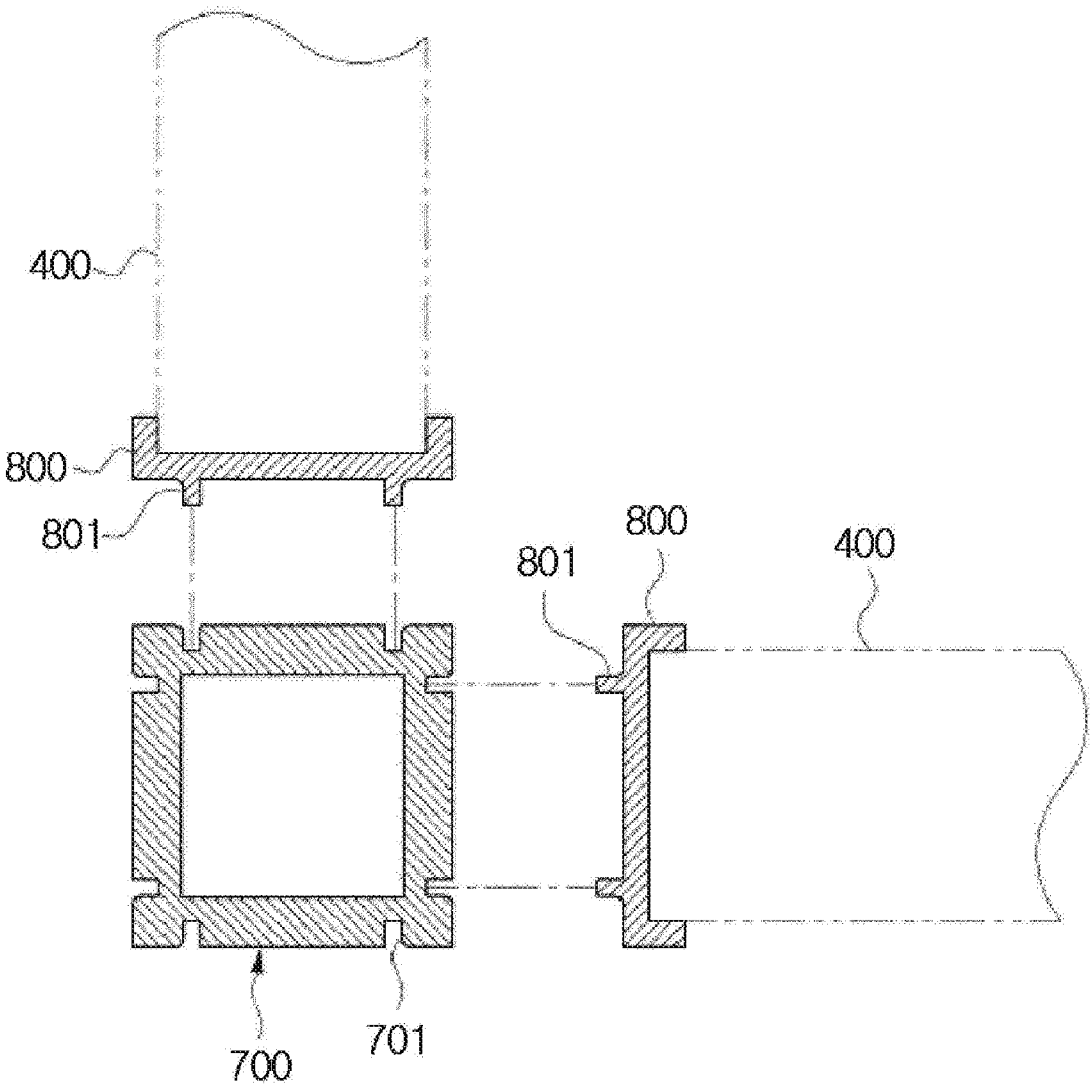
FIG. 11 is a view illustrating an embodiment in which a wall structure is installed by using a column post frame.

Also, as illustrated in FIG. 11, when a wall structure in one direction and a wall structure in a direction perpendicular to the one direction are to be connectedly installed, connection frames 800 are interposed on a post frame 700 to mount the flat panels 400 in installation directions of the wall structures.

That is, concave grooves 701 are formed on the post frame 700 in four directions, such that protrusions 801 formed on the connection frames 800 are fastened to each other. Thus, the assembly of the flat panel 400 is possible in the four horizontal and vertical directions. That is, when the wall structure and the wall structure in a perpendicular direction are to be connectedly installed, they may be freely constructed in the shapes of characters "L", "T", and "+" through the same method by using the post frame 700 and the connection frame 800.

FIGS. 5A-5E are views illustrating an embodiment of the formation of a wall structure in a construction panel assembly according to the first embodiment.

Figure 5A:
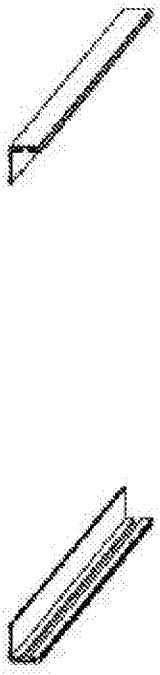
FIGS. 5A-5E are views illustrating an embodiment of the formation of a wall structure in a construction panel assembly according to the first embodiment.
Figure 5B:
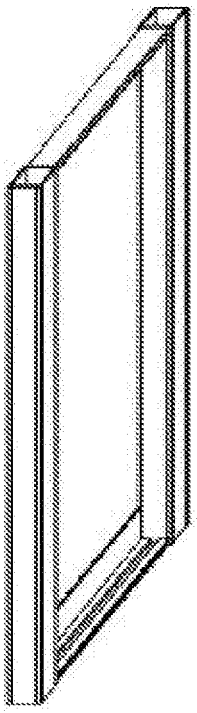

FIG. 5A is a view illustrating a state in which the upper and lower first main frames 210 are installed, and FIG. 5B is a view illustrating a state in which the post frame 700 is installed.

Figure 5C:
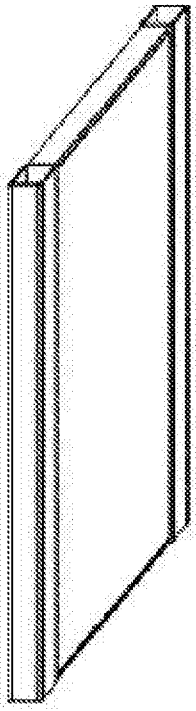
Figure 5D:
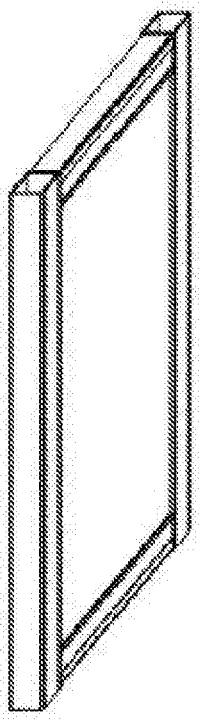
Figure 5E:
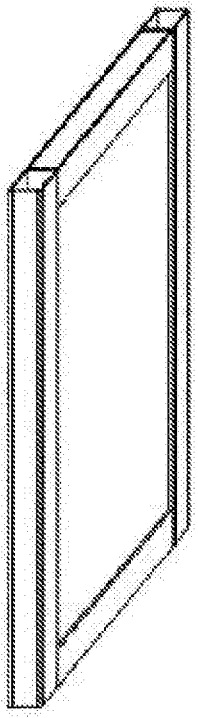

FIG. 5C is a view illustrating a state in which the flat panel 400 is installed, FIG. 5D is a view illustrating a state in which the flat panel fixing member 310 is installed, and FIG. 5E is a view illustrating a state in which the molding 510 and the washboard 610 are installed.

A construction method according to an embodiment may be used to construct not only a wall structure, but also a ceiling or a floor, and may be used for a well ceiling and an image wall through the same method. In other words, when the first main frame 210 is in an up-and-down vertical direction or a left-to-light horizontal direction, or also when the first main frame 210 has a partial installation area, the same construction method may be used with a change only in the position of the first main frame 210.

Hereinafter, a construction panel assembly and a construction method using the same according to a second embodiment will be firstly described.

Figure 6:
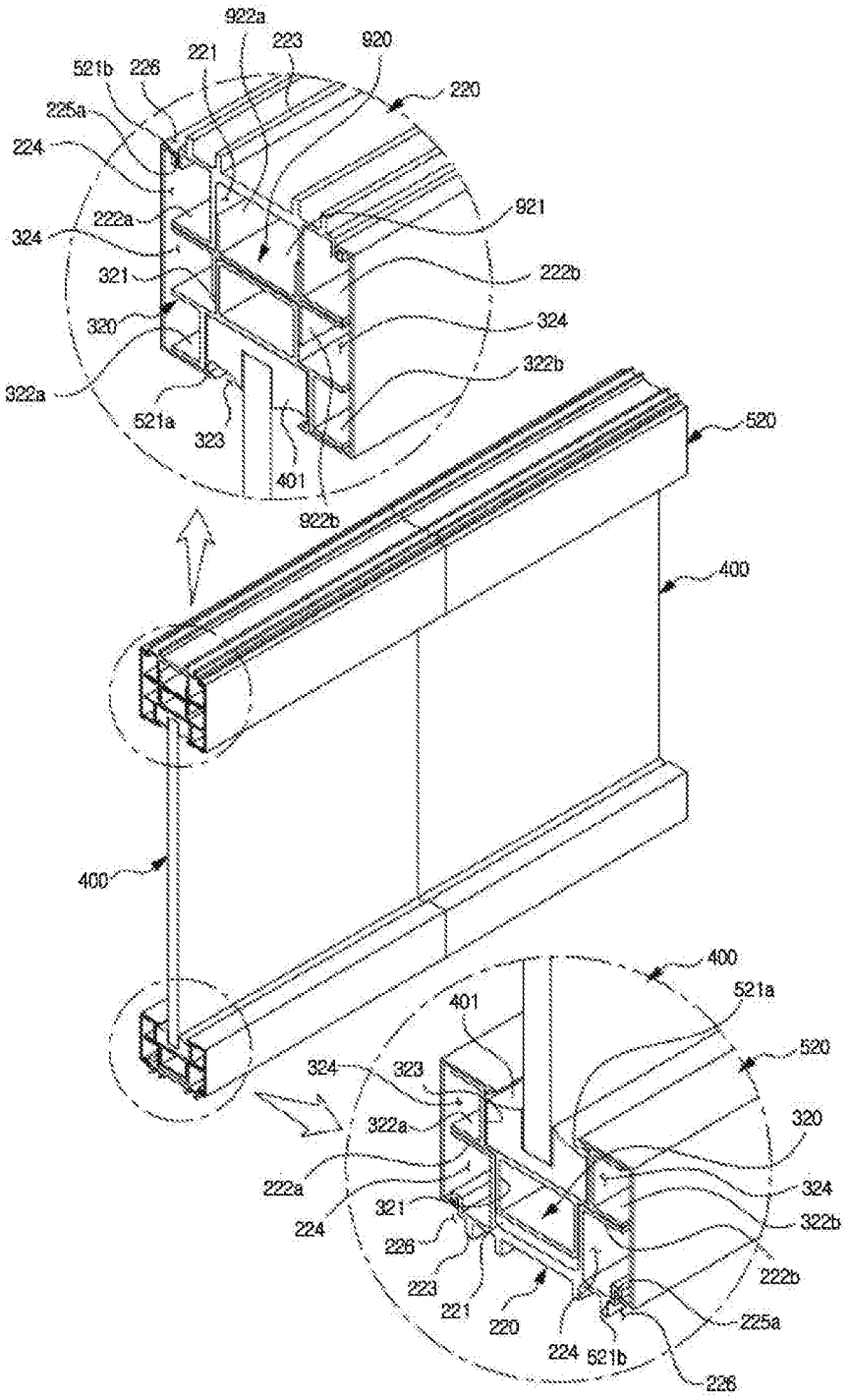
FIG. 6 is an overall perspective view illustrating a construction panel assembly according to a second embodiment.
Figure 7:
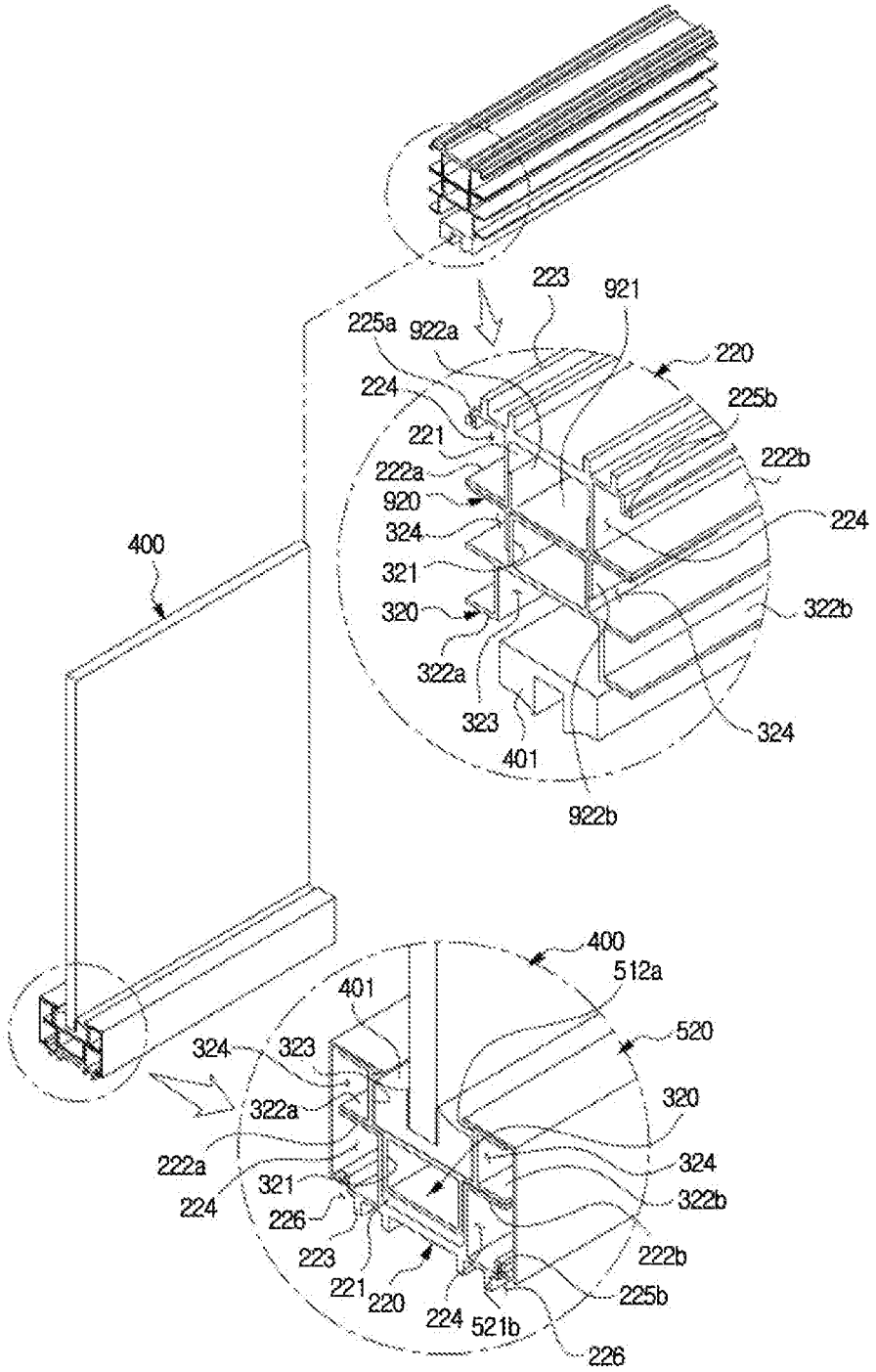
FIG. 7 is a perspective view illustrating a state in which a finishing cover is detached from a construction panel assembly according to the second embodiment.
Figure 8:
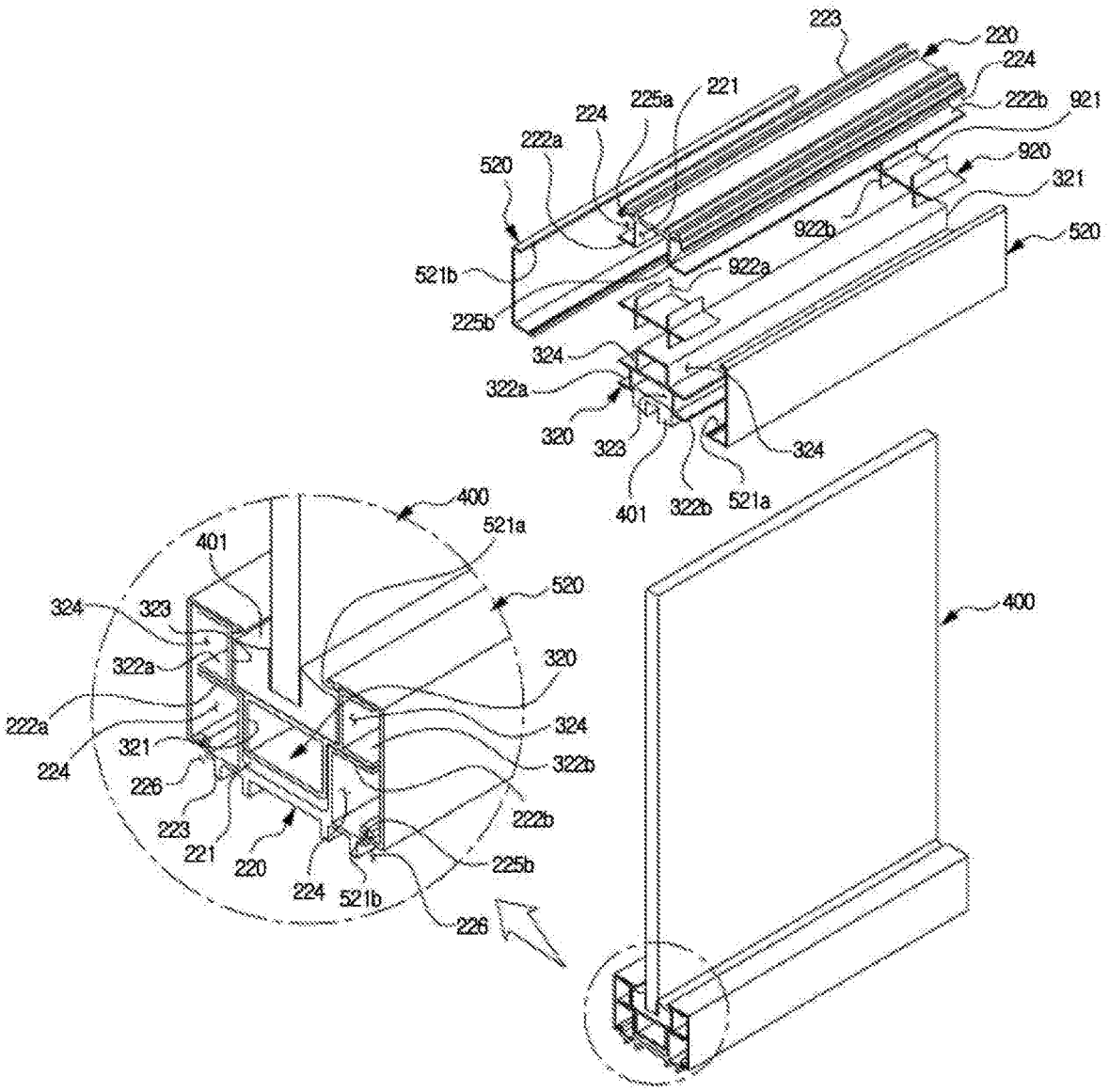
FIG. 8 is a perspective view illustrating a state in which main and intermediate frames are detached from a construction panel assembly according to the second embodiment.
Figure 9:
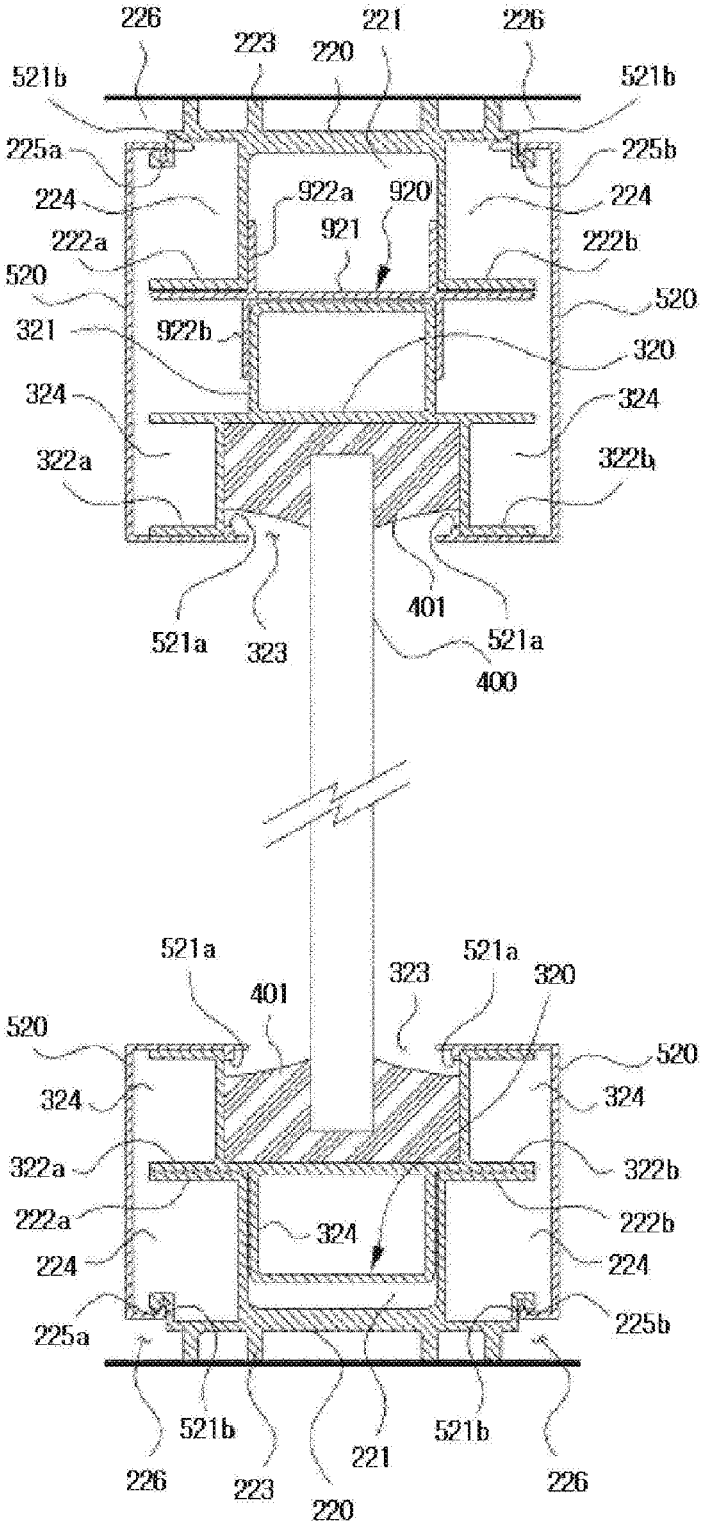
FIG. 9 is a cross-sectional view illustrating a state in which a flat panel is assembled in a construction panel assembly according to the second embodiment.
Figure 10:
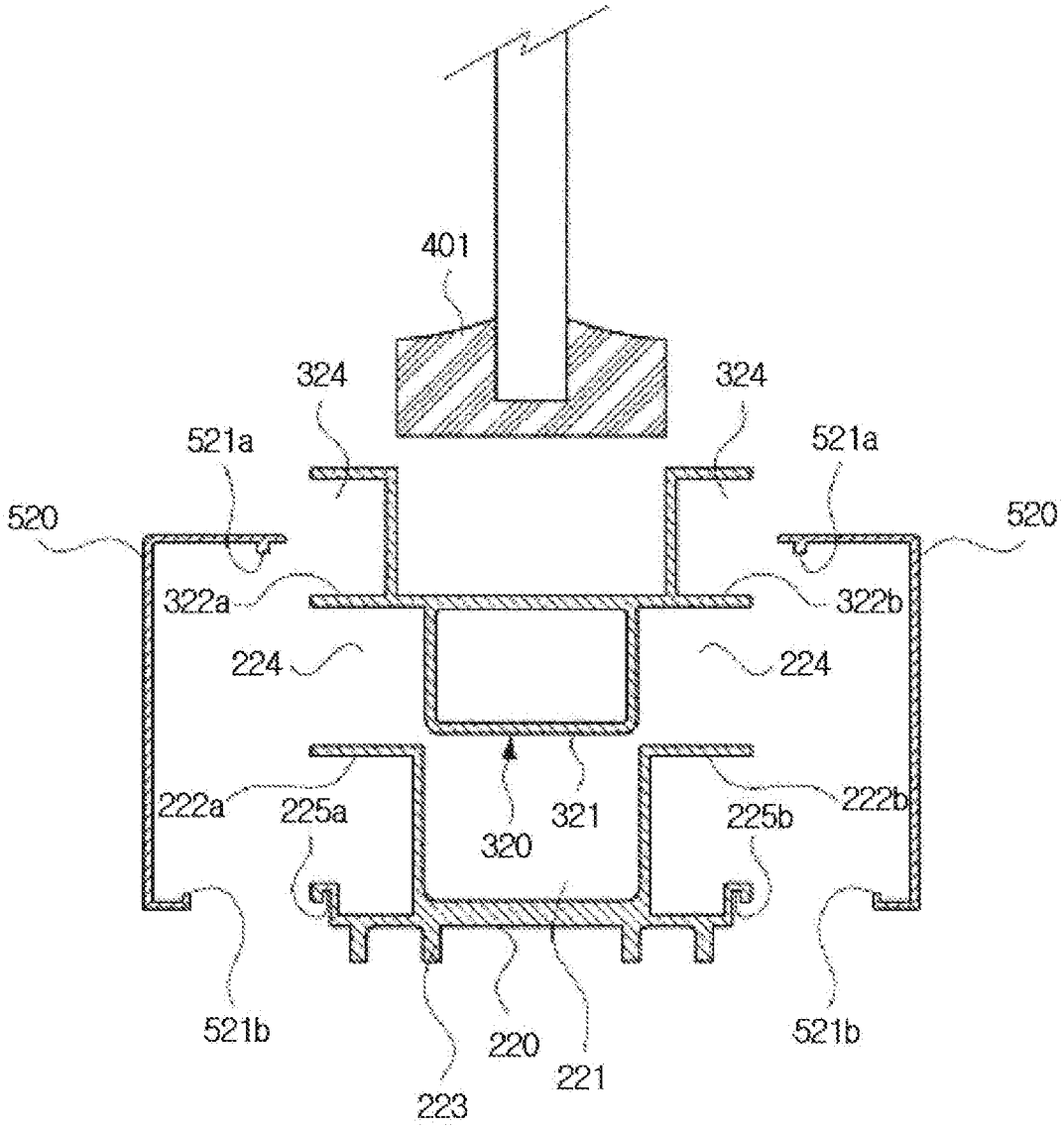
FIG. 10 is a view illustrating a state in which each frame and finishing panel of a construction panel assembly according to the second embodiment are disassembled.

FIG. 6 is an overall perspective view illustrating a construction panel assembly according to a second embodiment, FIG. 7 is a perspective view illustrating a state in which a finishing cover is detached from a construction panel assembly according to the second embodiment, FIG. 8 is a perspective view illustrating a state in which main and intermediate frames are detached from a construction panel assembly according to the second embodiment, FIG. 9 is a cross-sectional view illustrating a state in which a flat panel is assembled in a construction panel assembly according to the second embodiment, FIG. 10 is a view illustrating a state in which each frame and finishing panel of a construction panel assembly according to the second embodiment are disassembled, and FIG. 11 is a view illustrating an embodiment in which a wall structure is installed by using a column post frame.

In the second embodiment, the main frame includes a second main frame 220, the auxiliary frame includes an intermediate frame 320 inserted into the second main frame 220, the finishing member includes a finishing cover 520 for shielding a connection portion of the second main frame 220 and the intermediate frame 320, and the flat panel 400 is mounted between the intermediate frames 320 to partition a space.

As illustrated in the drawings, the present disclosure may be most preferably applied to a wall structure for partitioning a space in a building, and includes: second main frames 220 basically fixedly installed between a ceiling wall structure and a floor wall structure; intermediate frames 320 inserted between the second main frames 220, flat panels 400 mounted between the intermediate frames 320, and finishing covers 520 for shielding a connection portion of the second main frames 220 and the intermediate frames 320.

The second main frames 220 are installed opposite each other on a wall surface at a position determined according to design specifications. That is, the second main frame 220 may be simply fixed by using a fastening element, such as a small screw (not shown), while the second main frame 220 is arranged along reference lines (not shown) marked on the wall surface.

Also, a mounting groove 221 is formed in a central portion of the second main frame 220, and support members 222*a* and 222*b* having openings at both sides of the mounting groove 221 are simultaneously formed. The second main frame 220 includes a plurality of reinforcement protrusions 223 formed integrally on a bottom surface thereof in order to maintain a gap during attachment thereof to a wall surface.

The intermediate frame 320 includes a central insertion groove 323 which is defined by a protrusion portion 321 inserted into the mounting groove 221 of the second main frame 220, and supporting members 322*a* and 322*b* formed at both sides of the protrusion portion 321.

Also, the flat panel 400 is inserted into the insertion groove 323 of the intermediate frame 320 to form a wall surface. Almost all materials formed in panels, such as wood, gypsum board, steel, and glass plate, may be used as materials for the flat panel 400. When the flat panel 400 is formed of glass, it is preferably formed by interposing molding members 401 at both upper ends and both lower ends thereof.

The finishing cover 520 is installed by being elastically inserted such that the support members 222*a* and 222*b* of the second main frame 220 and the reinforcement members 322*a* and 322*b* of the intermediate frame 320 may be simultaneously shielded.

That is, protrusions 521*a* and 521*b* are formed at both upper ends and both lower ends of the finishing cover 520, are coupled to stop recesses 225*a* and 226*b* formed at both ends of the bottom surface of the second main frame 220 and reinforcement members 322*a* and 322*b* of the intermediate frame 320, and may thus be assembled with or disassembled from each other.

At upper end portions of the second main frame 220 and the intermediate frame 320, fixing members 920 may be interposed to provide a coupling force. The fixing members 920 are formed in such a way that pairs of vertical bodies 922*a* and 922*b* are integrally formed on upper and lower surfaces of a single horizontal body 921, respectively.

In addition, wire insertion grooves 224 and 324, through which various kinds of wires for indoor wiring may pass, are formed in the reinforcement members 322*a* and 322*b* of the intermediate frame 320 and the support members 222*a* and 222*b* of the second main frame 220. As a groove 226 is formed between a bottom surface of the second main frame 220 and the finishing cover 520, it may be caulked by using a typical material such as epoxy or polyester.

Also, as illustrated in FIG. 11, when a wall structure in one direction and a wall structure in a direction perpendicular to the one direction are to be connectedly installed, connection frames 800 are interposed on a post frame 700 to mount the flat panels 400 in installation directions of the wall structures.

That is, concave grooves 701 are formed on the post frame 700 in four directions, such that protrusions 801 formed on the connection frames 800 are fastened to each other. Thus, the assembly of the flat panel 400 is possible in each of the horizontal and vertical directions.

To construct a wall structure for partitioning an indoor space according to the above-described configuration, a reference line (not shown) is marked on a ceiling surface and a floor surface based on design specifications, and the second main frame 220 is then arranged and simultaneously fastened and fixed by screws (not shown).

Here, as a plurality of reinforcement protrusions 223 are integrally formed on a bottom surface of the second main frame 220, a predetermined gap is maintained when the second main frame 220 is coupled to a wall surface, and thus, supporting force may further be reinforced.

Here, since a plurality of reinforcement protrusions 223 are integrally formed on a bottom surface of the second main frame 220, the second main frame 220 may be more firmly constructed without distortion, and also a predetermined gap is maintained when the second main frame 220 is coupled to a floor surface of a building. Thus, supporting force may further be reinforced and the caulking operation may be more easily performed.

Next, an insertion groove 323 formed in the intermediate frame 320 is inserted and installed in a coupling portion of a flat panel 400, and both ends of an intermediate frame 320, on which the flat panel 400 is installed, may be installed by being inserted into a mounting groove 221 formed on the second main frame 320.

Thus, like in a method of assembling a typical window to a window frame, a protrusion portion 321 of the intermediate frame 320, on which the flat panel 400 is mounted, is inserted into the mounting groove 221 formed in the second main frame 220, first from a lower side of the second main frame 220, and then upwardly pushed so as to be vertically installed.

Also, a fixing member 920 is interposed between the second main frame 220 and the intermediate frame 320, which are disposed at the ceiling wall structure side, such that the second main frame 220 and the intermediate frame 320 may maintain a state of being firmly coupled.

That is, in a state in which a horizontal body 921 and a vertical body 922*a* of the fixing member 920 are interposed at the protrusion portion 321 of the intermediate frame 320, the vertical body 922*b* on the other side is brought in close contact with an inner surface of the insertion groove 221 of the second main frame 220, and may thus be assembled.

As such, in a state in which the second main frame 220, the intermediate frame 320, and the flat panel 400 are installed, various kinds of wires may be arranged by using wire insertion grooves 224 and 324 formed at both sides of these frames, and a finishing cover 520 is mounted on a connection portion of the second main frame 220 and the intermediate frame 320.

Here, in a state in which a protrusion 521*b* formed at a lower end portion of the finishing cover 520 is inserted into stop recesses 225*a* and 225*b* of the second main frame 220, a protrusion 521*a* formed at an upper end portion of the finishing cover 520 is pushed into reinforcement members 322*a* and 322*b* of the intermediate frame 320, and thus may be simply assembled.

Finally, a groove 226 formed between the second main frame and the finishing cover 520 is caulked and finished.

In the above-described embodiments, a method of installing a wall structure for partitioning a space by using the second main frame 220, the intermediate frame 320, and the flat panel 400 has been described. However, when the wall structure together with a wall structure perpendicular thereto are to be connectedly installed, they may be freely constructed in the shapes of characters such as "L", "T", and "+" through the same method by using a post frame 700 and a connection frame 800.

A construction method according to an embodiment is not limited to only a wall structure and may also be used to construct a ceiling or a floor, and may be used for a well ceiling and a sign image wall through the same method. In other words, when the second main frame 220 is in an up-and-down vertical direction or a left-to-light horizontal direction, or also when the second main frame 220 has a partial installation area, the same construction method may be used with a change only in the position of the second main frame 210.

According to embodiments, a construction panel assembly and a construction method using the same have the effects in that a panel formed of various materials, such as plate glass, a gypsum board, plywood, and steel, may be constructed to be freely assembled or disassembled by using a main frame and an auxiliary frame which constitute a structure, such that, unlike in the related art, materials may be reused, and accordingly, the generation of waste may be fundamentally prevented.

Also, since separate screws are not required between structure materials and finishing materials which constitute a wall structure, there are the effects in that the appearance is pleasing and construction is very simple, so that overall costs may be greatly saved.

Also, many components required to assemble a typical indoor wall structure are simplified, so that processes required for assembly, such as molding and painting, may be reduced and accordingly, manpower and manufacturing costs may be reduced.

Also, since the assembly and disassembly are simple, there is the effect in that a once-assembled wall structure may be disassembled and may be re-installed at other locations while the height, width, etc, thereof are arbitrarily adjusted and changed by a user.

Also, since various wires installed indoors may be configured to be disposed between structure materials and finishing materials, various kinds of wires may be freely and conveniently installed if the finishing materials are detached. Also, since wires may be freely disposed without being exposed to the outside even after the construction of the panel is completed, there is the effect in that indoor spaces may be more cleanly used.

The object of the present invention may be achieved by the aforementioned technical configurations, and although described with limited embodiments and drawings, the present invention is not limited thereto. It should be understood that various modifications and variations can be made by those skilled in the art in the field of present invention without departing from the spirit and scope of the invention. Accordingly, such modifications and variations should also be understood as falling within the claims of the present invention.

What is claimed is:

1. A construction panel assembly, comprising:

a main frame including a base panel, a left support member extended upward from the base panel, a right support member extended upward from the based panel and located at a distance from the left support member, and a first mounting groove defined by the based panel, the left and right support members and located at a central portion of the base panel, wherein the left support member comprises a first support member extended horizontally outward from one end thereof, and wherein the right support member comprises a second support member extended horizontally outward from one end thereof;

an intermediate frame including an intermediate flat panel, a lower panel, a left panel directly extended downward from the intermediate flat panel and connected to one end of the lower panel and a right panel directly extended downward from the intermediate flat panel and connected to another end of the lower panel, wherein the lower, left and right panels define a protrusion portion protruding downward from the intermediate flat panel; and a fixing member interposed between the main frame and the intermediate frame, the fixing member including a horizontal panel, a left lower panel extending downward from a left side of the horizontal panel toward the base panel, a right lower panel extending downward from a right side of the horizontal panel toward the base panel, a left upper panel extending upward from the left side of the horizontal panel toward the intermediate flat panel, and a right upper panel extending upward from the right side of the horizontal panel toward the intermediate flat panel, wherein a left end portion of the horizontal panel of the fixing member is in contact with the first support member of the left support member, wherein a right end portion of the horizontal panel of the fixing member is in contact with the second support member of the right support member, wherein the left lower and right lower panels of the fixing member are disposed inside the first mounting groove and engages with the first mounting groove, wherein an entire outside surface of the left lower panel of the fixing member is in contact with an inside surface of the left support member, and an entire outside surface of the right lower panel of the fixing member is in contact with an inside surface of the right support member, wherein the intermediate frame further includes a left upper panel extended upward from the intermediate flat panel and a right upper panel extended upward from the intermediate flat panel and located at distance from the left upper panel of the intermediate frame to define a recess, and wherein the recess is configured to fixedly receive a flat panel to partition a space.

2. The construction panel assembly of claim 1, wherein the horizontal panel and the left and right upper panels of the fixing member define a second mounting groove, and wherein the protrusion portion of the intermediate frame is disposed inside the second mounting groove.

3. The construction panel assembly of claim 2, wherein an outside surface of the left panel of the intermediate frame is in contact with an inside surface of the left upper panel of the fixing member.

4. The construction panel assembly of claim 2, wherein an outside surface of the right panel of the intermediate frame is in contact with an inside surface of the right upper panel of the fixing member.

5. The construction panel assembly of claim 2, wherein the protrusion portion of the intermediate frame is disposed on an upper surface of the horizontal panel of the fixing member.

6. The construction panel assembly of claim 2, wherein an outside surface of the left panel of the intermediate frame is in contact with an inside surface of the left upper panel of the fixing member, wherein an outside surface of the right panel of the intermediate frame is in contact with an inside surface of the right upper panel of the fixing member, and wherein the protrusion portion of the intermediate frame is disposed on an upper surface of the horizontal panel of the fixing member.

7. The construction panel assembly of claim 1, wherein the base panel of the main frame comprises a reinforcement protrusion integrally disposed on a bottom surface thereof such that a gap is maintained when being coupled to a floor or a ceiling.

8. The construction panel assembly of claim 1, further comprising a left or right finishing cover for shielding a left or right connection portion of the main frame and the intermediate frame, wherein the left or right finishing cover includes a lower surface having an protrusion located at an end thereof, and wherein the base panel includes a fixing groove located at a left or right end thereof and engages with the left or right protrusion of the finishing cover.

9. The construction panel assembly of claim 1, wherein the main frame and the intermediate frame respectively comprise wire insertion grooves through which a wire passes.

10. A method of constructing a construction panel assembly applicable to a ceiling, a wall or a floor for partitioning a space in a building, the method comprising:

marking a reference line on a wall surface at a predetermined position based on design specifications;

disposing and fixing a main frame along the reference line, the main frame including a base panel, a left support member extended upward from the base panel, a right support member extended upward from the based panel and located at a distance from the left support member, and a first mounting groove defined by the based panel, the left and right support members and located at a central portion of the base panel, wherein the left support member comprises a first support member extended horizontally outward from one end thereof, and wherein the right support member comprises a second support member extended horizontally outward from one end thereof;

inserting a flat panel into a recess formed in an intermediate frame, the intermediate frame including an intermediate flat panel, a lower panel, a left panel directly extended downward from the intermediate flat panel and connected to one end of the lower panel and a right panel directly extended downward from the intermediate flat panel and connected to another end of the lower panel, wherein the lower, left and right panels define a protrusion portion protruding downward from the intermediate flat panel; and inserting a fixing member into the first mounting groove, the fixing member including a horizontal panel, a left lower panel extending downward from a left side of the horizontal panel toward the base panel, a right lower panel extending downward from a right side of the horizontal panel toward the base panel, a left upper panel extending upward from the left side of the horizontal panel toward the intermediate flat panel, and a right upper panel extending upward from the right side of the horizontal panel toward the intermediate flat panel, wherein a left end portion of the horizontal panel of the fixing member is in contact with the first support member of the left support member, wherein a right end portion of the horizontal panel of the fixing member is in contact with the second support member of the right support member, wherein an entire outside surface of the left lower panel of the fixing member is in contact with an inside surface of the left support member, and an entire outside surface of the right lower panel of the fixing member is in contact with an inside surface of the right support member, wherein the intermediate frame further includes a left upper panel extended upward from the intermediate flat panel and a right upper panel extended upward from the intermediate flat panel and located at distance from the left upper panel of the intermediate frame to define the recess, and wherein the recess is configured to fixedly receive the flat panel to partition a space.

11. The method of claim 10, further comprising inserting the protrusion portion of the intermediate frame into a second mounting groove defined by the horizontal panel and the left and right upper panels of the fixing member.

12. The method of claim 11, wherein an outside surface of the left panel of the intermediate frame is in contact with an inside surface of the left upper panel of the fixing member.

13. The method of claim 11, wherein an outside surface of the right panel of the intermediate frame is in contact with an inside surface of the right upper panel of the fixing member.

14. The method of claim 11, further comprising disposing the protrusion portion of the intermediate frame on an upper surface of the horizontal panel of the fixing member.

15. The method of claim 11, wherein an outside surface of the left panel of the intermediate frame is in contact with an inside surface of the left upper panel of the fixing member, wherein an outside surface of the right panel of the intermediate frame is in contact with an inside surface of the right upper panel of the fixing member, and wherein the method further comprises disposing the protrusion portion of the intermediate frame on an upper surface of the horizontal panel of the fixing member.

16. The method of claim 10, wherein the base panel of the main frame comprises a reinforcement protrusion integrally disposed on a bottom surface thereof such that a gap is maintained when being coupled to a floor or a ceiling.

17. The method of claim 10, further comprising shielding a left or right connection portion of the main frame and the intermediate frame by a left or right finishing cover, wherein the left or right finishing cover includes a lower surface having an protrusion located at an end thereof, and wherein the base panel includes a fixing groove located at a left or right end thereof and engages with the left or right protrusion of the finishing cover.

18. The method of claim 10, further comprising running a wire through insertion grooves disposed in the main frame and the intermediate frame respectively.

* * * * *